US007130552B2

(12) United States Patent
Nishida et al.

(10) Patent No.: US 7,130,552 B2
(45) Date of Patent: Oct. 31, 2006

(54) IMAGE FORMING APPARATUS

(75) Inventors: Satoshi Nishida, Hachioji (JP); Hiroaki Miho, Hachioji (JP); Shigetaka Kurosu, Hachioji (JP); Mikihiko Takada, Hachioji (JP); Hiroshi Morimoto, Hachioji (JP); Masashi Saito, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 82 days.

(21) Appl. No.: 10/781,620

(22) Filed: Feb. 20, 2004

(65) Prior Publication Data

US 2004/0234287 A1 Nov. 25, 2004

(30) Foreign Application Priority Data

May 22, 2003 (JP) ..... 2003-144704

(51) Int. Cl.
*G03G 15/16* (2006.01)

(52) U.S. Cl. ..... 399/66; 399/39; 399/55; 399/303; 399/299

(58) Field of Classification Search ..... 399/66
See application file for complete search history.

(56) References Cited

U.S. PATENT DOCUMENTS 5,303,013 A * 4/1994 Koike et al. ..... 399/302
6,564,021 B1 * 5/2003 Nakai et al. ..... 399/49
2003/0095815 A1 * 5/2003 Nakagawa et al. ..... 399/299

FOREIGN PATENT DOCUMENTS

JP 2000-98758 9/1998
JP 11-249371 9/1999

* cited by examiner

*Primary Examiner*—David M. Gray
*Assistant Examiner*—Ryan D. Walsh
(74) *Attorney, Agent, or Firm*—Finnegan, Henderson, Farabow, Garrett & Dunner, L.L.P.

(57) ABSTRACT

An image forming apparatus having: a transfer section which transfers a toner image onto an intermediate transfer body or a transfer material to form an image thereon; a selection section for selecting one mode among a plurality of modes including a first mode for forming the image by using a plurality of colors including a first color and a second mode for forming the image by using less number of colors including the first color than that of the colors in the first mode; and a control section for controlling the transfer section in order that a transfer rate of a toner image of the first color in the second mode is larger than that of a toner image of the first color in the first mode when toner images are transferred onto the intermediate transfer body or the transfer material by the transfer section.

24 Claims, 5 Drawing Sheets

IMAGE FORMING APPARATUS

BACKGROUND OF THE INVENTION

1. Field of the Invention

The present invention relates to an image forming apparatus capable of changing a color mode to a subtractive color mode and vice versa for use.

2. Description of the Related Art

Earlier, an image forming apparatus capable of changing a color mode to a subtractive color mode and vice versa for use on the occasion of transferring toner images from a plurality of image bearing bodies to an endless belt-like intermediate transfer body or to a transfer material carried on the endless belt-like intermediate transfer body together with it has had the following two problems.

a) Peeling discharges are generated when the endless belt-like intermediate transfer body or the transfer material is separated from the image bearing bodies after transfers owing to a change of a resistance value of the endless belt-like intermediate transfer body or the transfer material, or owing to a rise of an electric potential of toner layers produced by superposing toner images colored in a plurality of colors.

b) Toners transferred onto the endless belt-like intermediate transfer body or the transfer material are changed in their charges and polarities at the time of the transfer of the next color or the color after the next, and are re-transferred onto the image bearing bodies.

As measures for solving the problems, the following means have been tried generally: decreasing a toner mass of deposit, decreasing a toner quantity of charging, decreasing a resistivity of the endless belt-like intermediate transfer body, selecting a transfer output in which the above-mentioned problems are difficult to occur, or the like. There was also a trail of combining the several measures for preventing the occurrences of the phenomena described above in the case of superposing a plurality of color toners, ordinarily two or more color toners.

In addition, there is also an image forming apparatus disclosed in, for example, Japanese Patent Application Publication (Unexamined) No. Tokukaihei-11-249371. The image forming apparatus is a color image forming apparatus using four color toners. When only a black toner is used in case of forming a monochrome image by this image forming apparatus, the other three color image bearing bodies are not made to contact with an endless belt-like intermediate transfer body or a transfer material carried together with it. In this case, only the transfer of the black toner should be considered. However, because transfer outputs in this case are set to be the same as those in case of transferring the four color toners, the output level of the black toner remains small. Consequently, such the image forming apparatus has a defect of resulting in an insufficiently transferred image in a monochrome mode.

Moreover, in the subtractive color mode using two color toners, normally, four image bearing bodies ordinarily contact with the endless belt-like intermediate transfer body, and in such a state, only two color toners are used. Consequently, transfers from the image bearing bodies of the residual two colors are unnecessary. However, in this case, the following problem is produced. That is, when a transferring image (a toner image) on which the above-mentioned two color toners have been transferred passes transfer positions of the image bearing bodies of the residual two color toners, the toners on the endless belt-like intermediate transfer bodies are re-transferred on the residual two color toner image bearing bodies.

For example, a technique disclosed in Japanese Patent Application Publication (Unexamined) No. Tokukai-2000-98758 copes with such problems by arranging a transfer section to each of the four image bearing bodies through the endless belt-like intermediate transfer body, and by setting transfer outputs of two transfer sections at two end positions on the uppermost stream and the lowermost stream to be larger than transfer outputs of two transfer sections at two positions in the central part. Moreover, because the transfer outputs of the transfer sections at the two end positions are set to be larger in a plural color mode than those in a monochrome mode, re-transferring becomes inevitable and good results are not necessarily obtained.

SUMMARY OF THE INVENTION

An object of the present invention is to provide an image forming apparatus capable of solving each problem of the earlier developed techniques described above to make it possible to form a high quality image. In particular, a first object of the present invention is to provide an image forming apparatus capable of preventing decreases of transfer rates and of preventing re-transfer of toners. A second object of the present invention is to provide an image forming apparatus capable of preventing a peeling discharge in a transfer region.

For solving the problems, in accordance with a first aspect of the present invention, the image forming apparatus comprises:

a transfer section which transfers a toner image onto an intermediate transfer body or a transfer material to form an image on the intermediate transfer body or the transfer material;

a selection section for selecting one mode among a plurality of modes including a first mode for forming the image by using a plurality of colors including a first color and a second mode for forming the image by using less number of colors including the first color than that of the colors in the first mode; and a control section for controlling the transfer section in order that a transfer rate of a toner image of the first color in the second mode is larger than that of a toner image of the first color in the first mode when toner images are transferred onto the intermediate transfer body or the transfer material by the transfer section.

Preferably, the image is formed by using only one color in the second mode.

Preferably, the image forming apparatus further comprises a plurality of image bearing bodies, on which the toner images having different colors from one another are formed, wherein an image bearing body on which a toner image is not formed among the plurality of image bearing bodies is separated from the intermediate transfer body or the transfer material in the second mode.

Preferably, the control section controls a current value or a voltage value of the transfer section to control a transfer rate of each of the toner images.

Preferably, the image forming apparatus comprises the intermediate transfer body having an endless belt-like shape.

Preferably, the image forming apparatus further comprises a carry section for carrying the transfer material, which has an endless belt-like shape.

Preferably, the first mode is a full color mode using the toner images formed on all of the plurality of image bearing bodies, and the second mode is a monochrome mode using a toner image formed on one of the image bearing bodies among the plurality of image bearing bodies.

In accordance with a second aspect of the present invention, the image forming apparatus comprises:

a transfer section which transfers a toner image onto an intermediate transfer body or a transfer material to form an image on the intermediate transfer body or the transfer material;

a selection section for selecting one mode among a plurality of modes including a first mode for forming the image by using a first number of colors and a second mode for forming the image by using a number of colors which is smaller than the first number of colors; and a control section for controlling the transfer section in order that a transfer rate of a toner image in the second mode is larger than that of a toner image in the first mode with regard to at least one color used in the second mode when toner images are transferred onto the intermediate transfer body or the transfer material by the transfer section.

Preferably, the image is formed by using only one color in the second mode.

Preferably, the image forming apparatus further comprises a plurality of image bearing bodies, on which the toner images having different colors from one another are formed, wherein an image bearing body on which a toner image is not formed among the plurality of image bearing bodies is separated from the intermediate transfer body or the transfer material in the second mode.

Preferably, the control section controls a current value or a voltage value of the transfer section to control a transfer rate of each of the toner images.

Preferably, the image forming apparatus comprises the intermediate transfer body having an endless belt-like shape.

Preferably, the image forming apparatus further comprises a carry section for carrying the transfer material, which has an endless belt-like shape.

Preferably, the first mode is a full color mode using the toner images formed on all of the plurality of image bearing bodies, and the second mode is a monochrome mode using a toner image formed on one of the image bearing bodies among the plurality of image bearing bodies.

In accordance with a third aspect of the present invention, the image forming apparatus comprises:

a transfer section which transfers a toner image onto an intermediate transfer body or a transfer material to form an image on the intermediate transfer body or the transfer material;

a selection section for selecting one mode among a plurality of modes including a first mode for forming the image by using a plurality of colors and a second mode for forming the image by using less number of colors than that of the colors in the first mode; and a control section for controlling the transfer section in order that a transfer rate of a toner image in the second mode is larger than that of a toner image in the first mode when toner images are transferred onto the intermediate transfer body or the transfer material by the transfer section.

Preferably, the image is formed by using only one color in the second mode.

Preferably, the image forming apparatus further comprises a plurality of image bearing bodies, on which the toner images having different colors from one another are formed, wherein an image bearing body on which a toner image is not formed among the plurality of image bearing bodies is separated from the intermediate transfer body or the transfer material in the second mode.

Preferably, the control section controls a current value or a voltage value of the transfer section to control a transfer rate of each of the toner images.

Preferably, the image forming apparatus comprises the intermediate transfer body having an endless belt-like shape.

Preferably, the image forming apparatus further comprises a carry section for carrying the transfer material, which has an endless belt-like shape.

Preferably, the first mode is a full color mode using the toner images formed on all of the plurality of image bearing bodies, and the second mode is a monochrome mode using a toner image formed on one of the image bearing bodies among the plurality of image bearing bodies.

In accordance with a fourth aspect of the present invention, the image forming apparatus comprises:

a transfer section which transfers a toner image onto an intermediate transfer body or a transfer material to form an image on the intermediate transfer body or the transfer material;

a selection section for selecting one mode among a plurality of modes including a first mode for forming the image by using a plurality of colors including a first color and a second mode for forming the image by using less number of colors including the first color than that of the colors in the first mode; and a control section for controlling the transfer section in order that an output value for transferring a toner image of the first color in the second mode is larger than that for transferring a toner image of the first color in the first mode when toner images are transferred onto the intermediate transfer body or the transfer material by the transfer section.

Preferably, the image is formed by using only one color in the second mode.

Preferably, the image forming apparatus further comprises a plurality of image bearing bodies, on which the toner images having different colors from one another are formed, wherein an image bearing body on which a toner image is not formed among the plurality of image bearing bodies is separated from the intermediate transfer body or the transfer material in the second mode.

Preferably, the control section controls a current value or a voltage value of the transfer section to control the output value.

Preferably, the image forming apparatus comprises the intermediate transfer body having an endless belt-like shape.

Preferably, the image forming apparatus further comprises a carry section for carrying the transfer material, which has an endless belt-like shape.

Preferably, the first mode is a full color mode using the toner images formed on all of the plurality of image bearing bodies, and the second mode is a monochrome mode using a toner image formed on one of the image bearing bodies among the plurality of image bearing bodies.

In accordance with a fifth aspect of the present invention, the image forming apparatus comprises:

a plurality of image bearing bodies on which toner images having different colors from one another are formed;

a transfer unit comprising a plurality of transfer sections severally provided corresponding to each of the plurality of image bearing bodies for transferring the image formed on each of the plurality of image bearing bodies onto an intermediate transfer body or a transfer material; and a control section for controlling an output value of each of the plurality of transfer sections, wherein the control section controls the transfer unit in order that an output value of a transfer section provided correspondingly to an image bearing body other than a part of the image bearing bodies is smaller than that of a transfer section provided correspondingly to the part of the image bearing bodies when the toner image is formed on the part of the plurality of image bearing bodies to transfer the toner image on the intermediate transfer body or the transfer material.

Preferably, the control section controls the transfer unit in order that the output value of the transfer section provided correspondingly to the image bearing body other than the part of the image bearing bodies is halves or less of that of the transfer section provided correspondingly to the part of the image bearing bodies when the toner image is formed on the part of the plurality of image bearing bodies to transfer the toner image on the intermediate transfer body or the transfer material.

Preferably, the control section controls the transfer unit in order that the output value of the transfer section provided correspondingly to the image bearing body other than the part of the image bearing bodies is halves or less of that of the transfer section provided correspondingly to the part of the image bearing bodies, and is larger than zero, when the toner image is formed on the part of the plurality of image bearing bodies to transfer the toner image on the intermediate transfer body or the transfer material.

Preferably, the plurality of image bearing bodies contact with the intermediate transfer body or the transfer material, when the toner image is formed on the part of the plurality of image bearing bodies to transfer the toner image on the intermediate transfer body or the transfer material.

Preferably, the image forming apparatus comprises the intermediate transfer body having an endless belt-like shape.

Preferably, the image forming apparatus further comprises a carry section for carrying the transfer material, which has an endless belt-like shape, and the transfer unit transfers the toner image formed on each of the plurality of image bearing bodies onto the transfer material carried by the carry section.

Preferably, the number of the part of the plurality of image bearing bodies is one or two.

Preferably, the control section controls a current value or a voltage value of each of the transfer sections to control the output value.

Preferably, the image forming apparatus of each of the aspects is an image forming apparatus capable of switching modes between a full color mode for forming a transfer image by forming a toner image on each of a plurality of image bearing bodies, the toner images colored in different colors from one another, and by transferring the formed toner images onto an endless belt-like intermediate transfer body or a transfer material which is carried together with the endless belt-like intermediate transfer body, in a state of being superposed on one another, and a subtractive color mode for forming an image using only a part of image bearing bodies among the plurality of image bearing bodies, wherein, with regard to output values of respective transfer sections for transferring the toner images from the image bearing bodies to the endless belt-like intermediate transfer body or the transfer material, the output values of the transfer sections to be used for transferring only the toner images necessary for the subtractive color mode are made to be larger than the output values of all of the transfer sections at a time of the full color mode.

Preferably, one image bearing body is used in the subtractive color mode.

Preferably, an image bearing body which is not used in the subtractive color mode does not contact with the endless belt-like intermediate transfer body or the transfer material.

Preferably, an image forming apparatus for forming a transfer image by forming a toner image on each of a plurality of image bearing bodies, the toner images colored in different colors from one another, and by transferring the formed toner images onto an endless belt-like intermediate transfer body or a transfer material which is carried together with the endless belt-like intermediate transfer body, in a state of being superposed on one another, the image forming apparatus capable of switching modes between a full color mode using toners of all of the different colors and a subtractive color mode using toners of a part of the different colors, wherein, when an output value of the transfer section for transferring a toner image from an image bearing body corresponding to a toner of a color to be used in the subtractive color mode is one, output values of transfer sections for transferring toner images from image bearing bodies corresponding to toners of colors not to be used in the subtractive color mode are made to be a half or less including zero.

Preferably, all of the image bearing bodies contact with the endless belt-like intermediate body or the transfer material in the subtractive color mode.

Preferably, one or two colors of toners are used in the subtractive color mode.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

In the following, an embodiment of the present invention will be described. Incidentally, the description in this column does not limit the scope and the meaning of terminologies of claims. Moreover, the affirmative descriptions in the following embodiment of the present invention indicate the best mode, and the descriptions do not limit the meaning of terminologies and the scope of the present invention.

Figure 1:
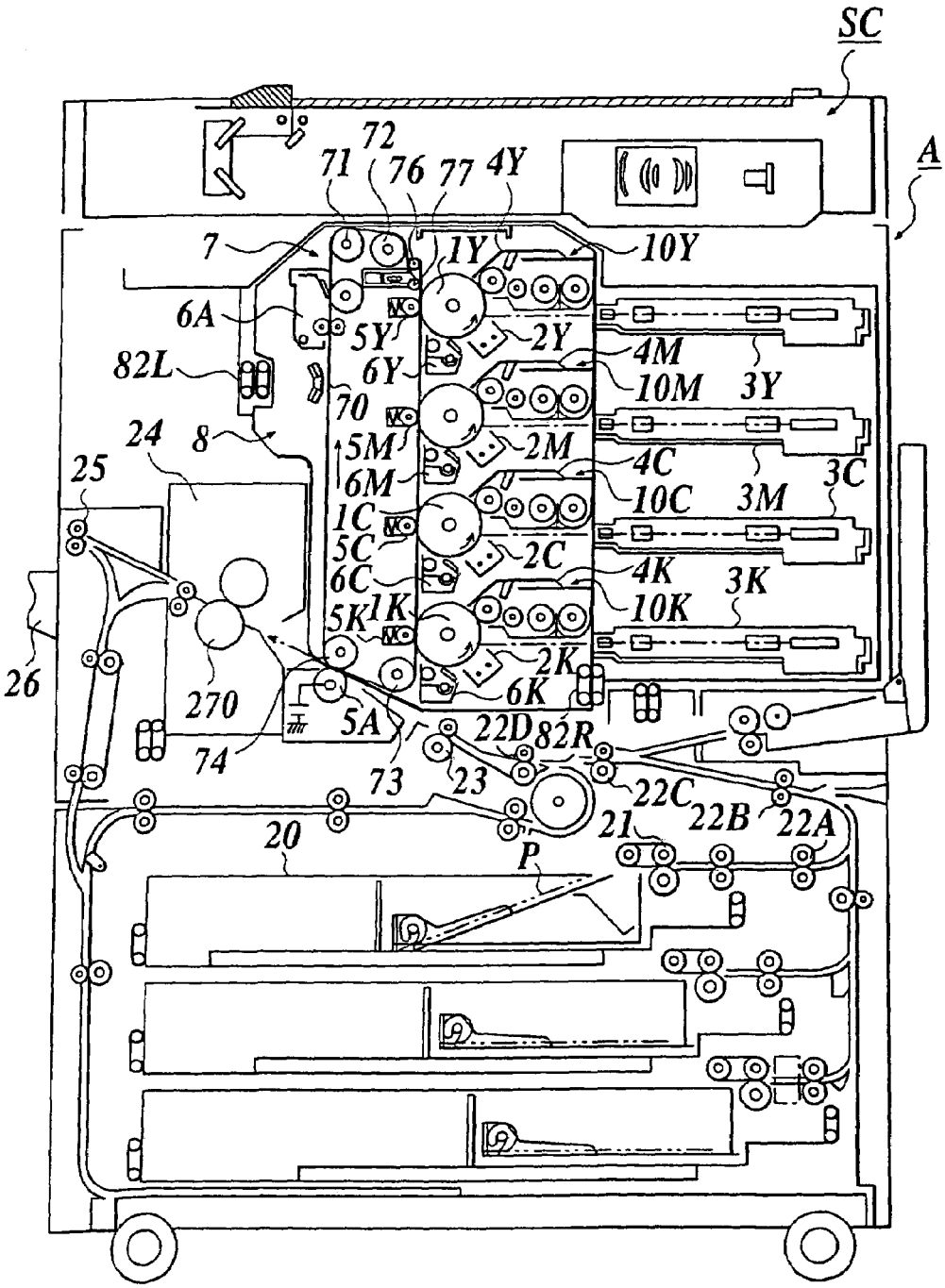
FIG. 1 is a sectional view showing the configuration of a color image forming apparatus as an embodiment of the image forming apparatus of the present invention.

FIG. 1 is a sectional view showing the configuration of a color image forming apparatus as an embodiment of the image forming apparatus of the present invention.

The color image forming apparatus is one called as a tandem color image forming apparatus, and comprises a plurality of sets of image formation units 10Y, 10M, 10C and 10K, an endless belt-like intermediate transfer body unit 7 as a transfer unit, an endless belt-like paper supply and carry section 21 for carrying a transfer material P, and a belt type fixing device 24 as a fixing device. An original image scanning device SC is arranged at the upper part of the main body A of the image forming apparatus.

An image formation unit 10Y forms a yellow image as one of the toner images each of which is to be formed on a corresponding photosensitive body and has a color different from the other colors of the other images. The image formation unit 10Y comprises a drum-like photosensitive body 1Y as one of first image bearing bodies, a charging section 2Y arranged in the vicinity of the photosensitive body 1Y, an exposure section 3Y, a development section 4Y, a primary transfer roller 5Y as one of primary transfer sections, and a cleaning section 6Y. Moreover, an image formation unit 10M for forming a magenta image as a toner image colored in a different color comprises a drum-like photosensitive body 1M as one of the first image bearing bodies, a charging section 2M arranged in the vicinity of the photosensitive body 1M, an exposure section 3M, a development section 4M, a primary transfer roller 5M as one of the primary transfer sections, and a cleaning section 6M. Moreover, an image formation unit 10C for forming a cyan image as a toner image colored in a further different color comprises a drum-like photosensitive body 1C as one of the first image bearing bodies, a charging section 2C arranged in the vicinity of the photosensitive body 1C, an exposure section 3C, a development section 4C, a primary transfer roller 5C as one of the primary transfer sections, and a cleaning section 6C. Moreover, an image formation unit 10K for forming a black image as a toner image colored in a still further different color comprises a drum-like photosensitive body 1K as one of the first image bearing bodies, a charging section 2K arranged in the vicinity of the photosensitive body 1K, an exposure section 3K, a development section 4K, a primary transfer roller 5K as one of the primary transfer section, and a cleaning section 6K.

The endless belt-like intermediate transfer body unit 7 comprises an endless belt-like intermediate transfer body 70 as a semiconductive endless belt-like second image bearing body which is wound on a plurality of rollers to be rotatably supported by them.

An image of each color formed by each of the image formation units 10Y, 10M, 10C and 10K is transferred onto the revolving endless belt-like intermediate transfer body 70 by the primary transfer rollers 5Y, 5M, 5C and 5K continuously to form a synthesized color image. A transfer material P such as a paper as a recording medium contained in a paper supplying cassette 20 is supplied by the paper supply and carry section 21 to be carried by a secondary transfer roller 5A as a secondary transfer section through a plurality of intermediate rollers 22A, 22B, 22C and 22D, and a resist roller 23. Then, the color image is transferred to the transfer material P in a batch. The transfer material P on which the color image has been transferred is subjected to a fixing treatment by the belt type fixing device 24, and is put between discharge rollers 25 to be placed on a discharge tray 26 on the outside of the color image forming apparatus.

On the other hand, after the color image has been transferred on the transfer material P by the secondary transfer roller 5A and the transfer material P has been separated from the endless belt-like intermediate transfer body 70 by self stripping, residual toners on the endless belt-like intermediate transfer body 70 are removed by a cleaning section 6A.

During an image formation processing, the primary transfer roller 5K is always brought into contact with the photosensitive body 1K by pressurizing. The other primary transfer rollers 5Y, 5M and 5C are brought into contact with the corresponding photosensitive bodies 1Y, 1M and 1C by pressurizing, respectively, only at the time of a color image formation.

The secondary transfer roller 5A is brought into contact with the endless belt-like intermediate transfer body 70 by pressurizing only while the transfer material P passes by the secondary transfer roller 5A and a secondary transfer is performed.

Moreover, a casing 8 is configured to be able to be pulled out from the main body A of the apparatus through support rails 82L and 82R.

The casing 8 comprises the image formation units 10Y, 10M, 10C and 10K and the endless belt-like intermediate transfer body unit 7.

The image formation units 10Y, 10M, 10C and 10K are arranged in a column in a vertical direction. The endless belt-like intermediate transfer body unit 7 is arranged on the left side of the photosensitive bodies 1Y, 1M, 1C and 1K in FIG. 1. The endless belt-like intermediate transfer body unit 7 comprises the endless belt-like intermediate transfer body 70 which is wound on rollers 71, 72, 73, 74 and 76 to be able to revolve around them, the primary transfer rollers 5Y, 5M, 5C and 5K, and the cleaning section 6A.

By a pulling out operation of the casing 8, the image formation units 10Y, 10M, 10C and 10K and the endless belt-like intermediate transfer body unit 7 are also pulled out from the main body A in a body.

Thus, toner images are formed on the photosensitive bodies 1Y, 1M, 1C and 1K by charging, exposure and developing, and the toner images colored in respective colors are superposed on the endless belt-like intermediate transfer body 70. Then, the superposed toner image is collectively transferred onto the transfer material P, and the collectively transferred image is solidified by being pressed and heated by the belt type fixing device 24 to be fixed on the transfer material P. After the toner images have been transferred onto the transfer material P, toners remaining on the photosensitive bodies 1Y, 1M, 1C and 1K after the transfer are cleaned by the cleaning section 6A. After that, the above-mentioned cycle of charging, exposure and developing is started to form a next image.

The process speed of the image forming apparatus is 220 mm/s in the case of using an A-4 size sheet. Each of the primary transfer rollers 5Y, 5M, SC and 5K is a sponge roller having a resistance value of $1\times10^7$ Ω and a diameter of 20 mm. The transfer control is constant voltage control. At a full color mode, as shown in the sectional view of the configuration in FIG. 1 and the schematic diagram in FIG. 2, a pedestal 5T of each of the primary transfer rollers 5Y, 5M, 5C and 5K severally slides along a pin D in guide 5G to move in a direction of an arrow A. Then, the primary transfer rollers 5Y, 5M, SC and 5K are pressed to the photosensitive bodies 1Y, 1M, 1C and 1K, respectively, through the endless belt-like intermediate transfer body 70 by the operations of springs S. At a monochrome mode being a single color mode, as shown in the schematic diagram in FIG. 3, only the black primary transfer roller 5K is pressed to the black photosensitive body 1K through the endless belt-like intermediate transfer body 70. With regard to the colors of yellow Y, magenta M and cyan C, the pedestals 5T of the primary transfer rollers 5Y, 5M and 5C are moved toward an arrow B along the pins D, and thereby the contact and the pressing of the primary transfer rollers 5Y, 5M and 5C against the corresponding photosensitive bodies 1Y, 1M and 1C through the endless belt-like intermediate transfer body 70 are released.

Figure 2:
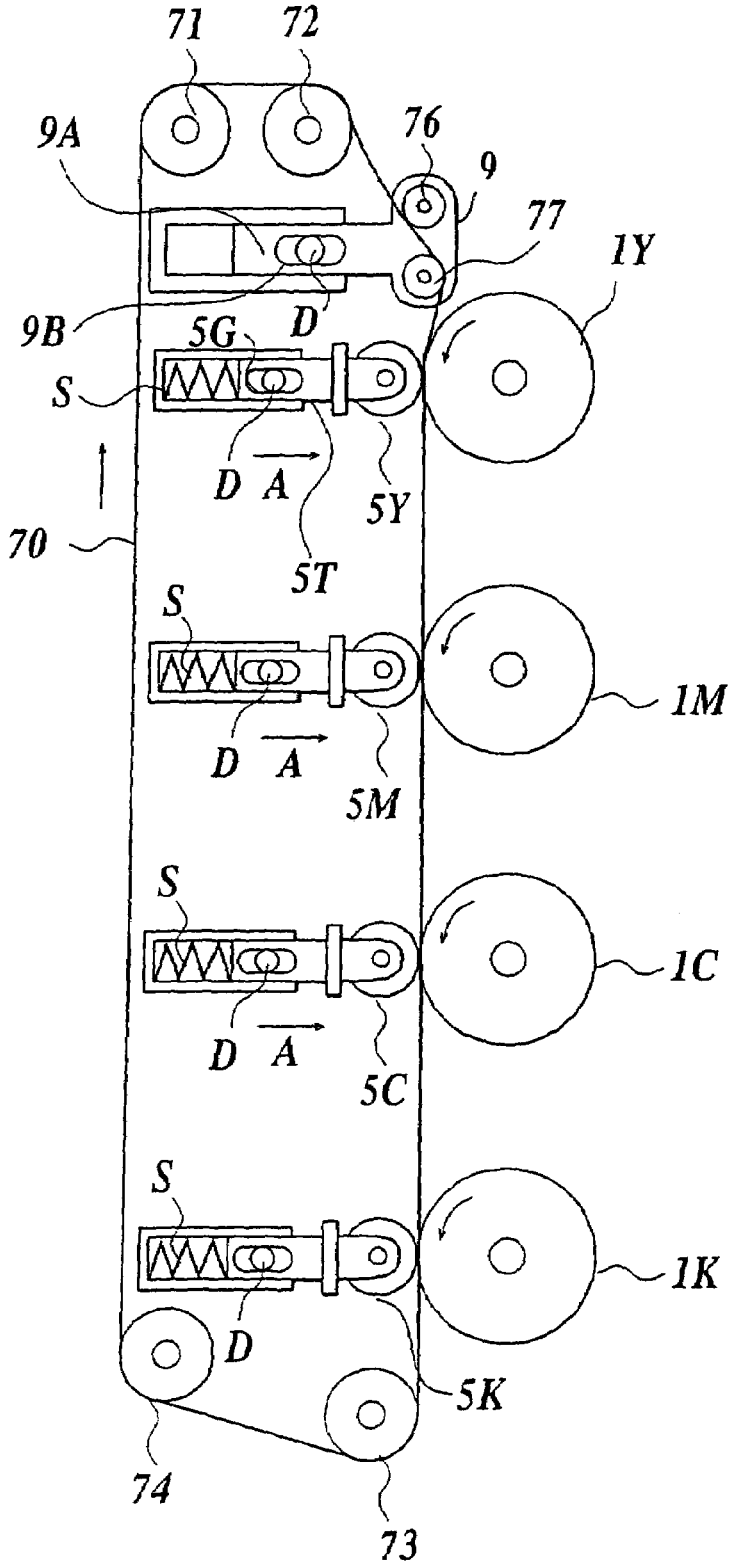
FIG. 2 is a schematic diagram showing an arrangement of photosensitive bodies and primary transfer sections at the time of full color image formation in the color image forming apparatus as the embodiment of the image forming apparatus of the present invention.
Figure 3:
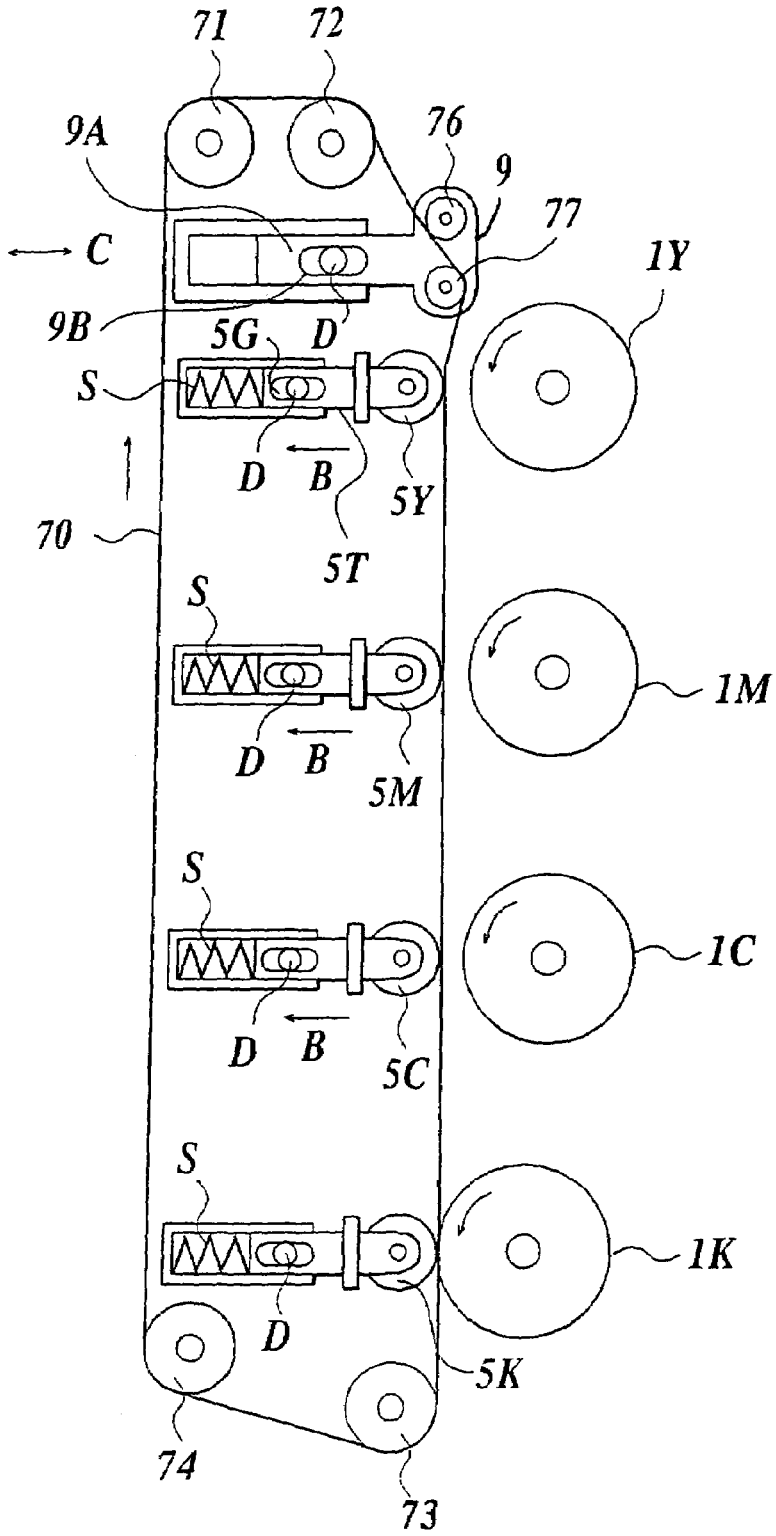
FIG. 3 is a schematic diagram showing another arrangement of the photosensitive bodies and the primary transfer sections at the time of black image formation in the color image forming apparatus as the embodiment of the image forming apparatus of the present invention.

A tension switching of the endless belt-like intermediate transfer body 70 at switching between the full color mode and the monochrome mode is performed by the sliding of the tension adjuster 9, shown in FIGS. 1, 2 and 3, into ±C directions. The tension adjuster 9 is configured in order that, for example, a pedestal 9A provided with the rollers 76 and 77 thereon slides to move on a guide 9B along the pin D.

Figure 4:
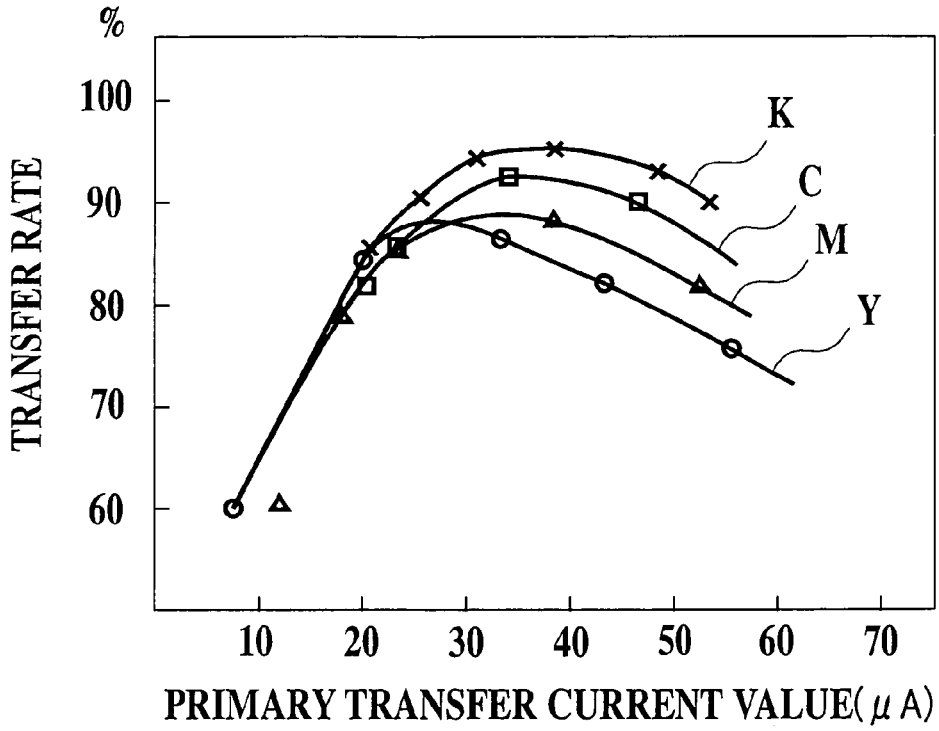
FIG. 4 is a graph showing relations between transfer current values of each primary transfer roller at the time of a full color mode and transfer rates from each photosensitive body to an endless belt-like intermediate transfer body or a transfer material.
Figure 5:
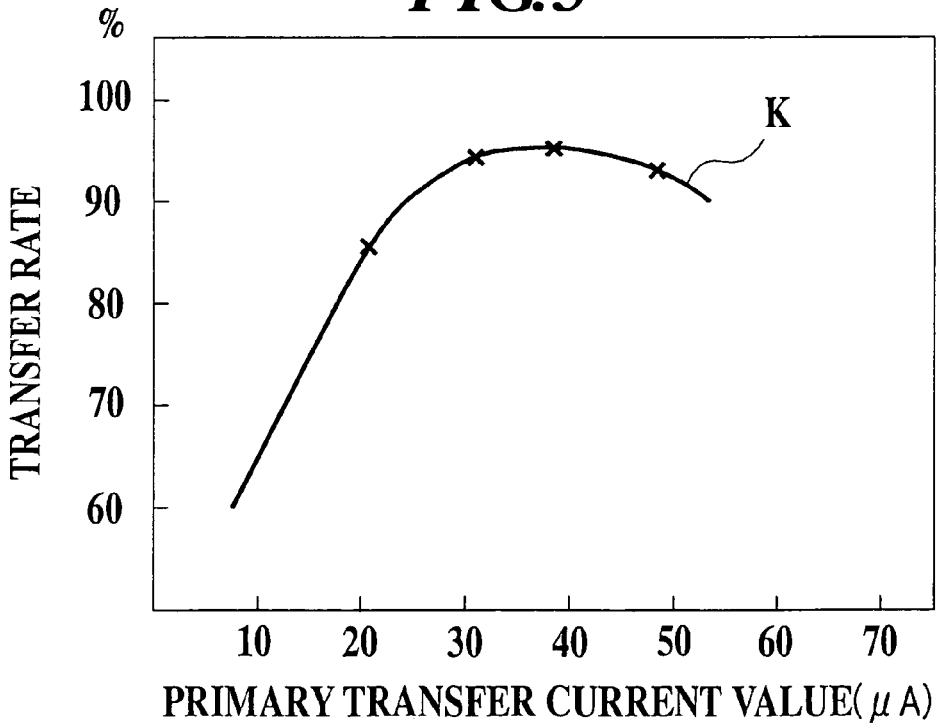
FIG. 5 is a graph showing a relation between transfer current values of a primary transfer roller at the time of a black (K) mode and transfer rates from a black photosensitive body to the endless belt-like intermediate transfer body or the transfer material.

Plotting the transfer rates of each toner image against changes of primary transfer currents at the time of the full color mode and at the time of the monochrome mode results in graphs in FIGS. 4 and 5.

At the time of the full color mode, as shown in FIG. 4, the transfer rate of yellow Y takes its peak of about 90% at a transfer current value of 25 μA. The transfer rate of magenta M takes its peak of about 92% at a transfer current value of 29 μA. The transfer rate of cyan C takes its peak of about 94% at a transfer current value of 32 μA. The transfer rate of black K takes its peak of about 96% at a transfer current value of 35 μA. All of the colors show high transfer rates of almost the same value of 90% at the transfer current value of 25 μA.

At the time of the monochrome mode as shown in FIG. 3, the transfer rates change as the graph shown in FIG. 5 is the same one as the curve of black K in the graph of FIG. 4. The peak transfer rate of the graph is about 96% at the transfer current value of 35 μA.

Accordingly, it is preferable to control the endless belt-like intermediate transfer body unit 7 in order that the transfer rate of a black toner image to the endless belt-like intermediate transfer body 70 at the time of the monochrome mode is larger than the transfer rate of the black toner image to the endless belt-like intermediate transfer body 70 at the time of the full color mode.

The endless belt-like intermediate transfer body unit 7 is, as described above, controlled in order that at least the transfer rate of the toner image of each color in a second mode is larger than the transfer rate of the toner image of the same color in a first mode. Hereupon, the second mode is one such as the monochrome mode for forming an image using fewer colors than the number of colors in the first mode such as the full color mode for forming an image using a plurality of colors. Thereby, the re-transfer of the toners can be prevented, and a desirable transfer rate can be obtained in the second mode.

Moreover, it is more preferable to control the transfer rate of each toner image in the first mode to be smaller than the transfer rate of the toner image of each color in the second mode. Furthermore, the transfer rate can be obtained by controlling the current value or the voltage value of each of the primary transfer rollers 5Y, 5M, 5C and 5K of the endless belt-like intermediate transfer body unit 7 as the transfer section.

In this case, it is preferable to control at least the current value or the voltage value of the primary transfer roller (the primary transfer roller 5K in the present embodiment) corresponding to the photosensitive body (the photosensitive body 1K in the present embodiment) on which a toner image is formed in the second mode to be larger in the second mode than in the first mode.

Moreover, it is preferable to control the current values or the voltage values of all of the primary transfer rollers 5Y, 5M, 5C and 5K in the first mode to be smaller than the current value or the voltage value in the second mode of the primary transfer roller corresponding to the photosensitive body on which a toner image is formed in the second mode.

Figure 6:
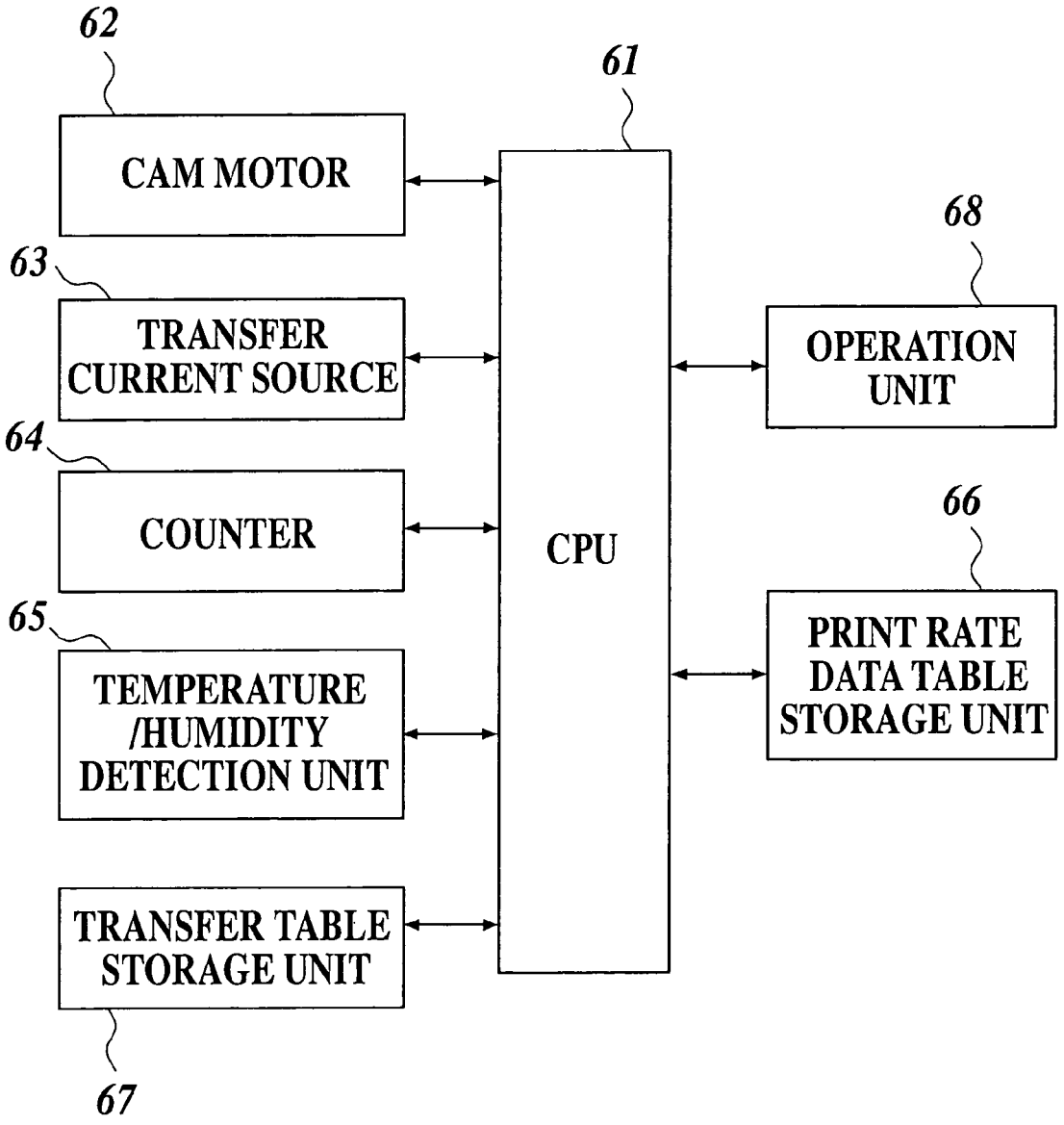
FIG. 6 is a block diagram showing the primary control section of the color image forming apparatus of the embodiment of the image forming apparatus of the present invention.

FIG. 6 is a block diagram showing the primary control section for performing the control described above. As shown in FIG. 6, the image forming apparatus 1 is provided with a central processing unit (CPU) 61 for sending control signals to each driving unit. The CPU 61 is electrically connected to a cam motor 62 for driving the pin D of each of the primary transfer rollers 5Y, 5M, 5C and 5K to press or to release each of the primary transfer rollers 5Y, 5M, 5C and 5K against or from each of the photosensitive bodies 1Y, 1M, 1C and 1K, and the endless belt-like intermediate transfer body 70. Moreover, the CPU 61 is electrically connected to a transfer power source 63 for supplying electric power to each of the primary transfer rollers 5Y, 5M, 5C and 5K at the time of a transfer, a counter 64 for counting the number of formed images, a temperature/humidity detection unit 65 for detecting temperature and humidity, a print rate data table storage unit 66 for storing a print rate data table for converting image data so as to correspond to each mode, and a transfer table storage unit 67 for storing the current value or the voltage value of each of the primary transfer rollers 5Y, 5M, 5C and 5K. The current value or the voltage value is set to result in a transfer rate corresponding to each mode. The control section of the present invention comprises the CPU 61, the cam motor 62, the transfer power source 63, the counter 64, the temperature/humidity detection unit 65, the print rate data table storage unit 66 and the transfer table storage unit 67.

Moreover, the CPU 61 is electrically connected to an operation unit 68 by which various instructions concerning a start of image formation, a mode of image formation and the like are input.

The CPU 61 recognizes a mode (the full color mode, the monochrome mode or the single color (red R, green G, blue B, yellow Y, magenta M or cyan C) mode) input from the operation unit 68 as a selection section, and controls the cam motor 62 according to the selected mode. Thereby, as shown in FIG. 3, the CPU 61 switches a contact state and a noncontact state between each of the photosensitive bodies 1Y, 1M, 1C and 1K and the endless belt-like intermediate transfer body 70 according to a selected mode.

Moreover, the CPU 61 converts an image data to correspond to the selected mode on the basis of the print rate data table stored in the print rate data table storage unit 66. Furthermore, the CPU 61 reads the current value or the voltage value of each of the primary transfer rollers 5Y, 5M, 5C and 5K from the transfer table stored in the transfer table storage unit 67 according to the selected mode so as to be a transfer rate corresponding to the mode. At this time, the CPU 61 corrects the current value or the voltage value according to a detection result of the temperature/humidity detection unit 65, and thereby setting the transfer rate fitted to the environment.

Then, after the toner images based on the print rate data table have been formed on each of the photosensitive bodies 1Y, 1M, 1C and 1K, the CPU 61 controls the transfer power source 63 on the basis of the corrected current value or the voltage value to control the transfer rate of each of the primary transfer rollers 5Y, 5M, 5C and 5K. Thereby, each toner image is transferred onto the endless belt-like intermediate transfer body 70.

To put it more concretely, in the case where the control of the transfer rate is performed on the basis of the current value, when the full color mode is selected, the CPU 61 controls the transfer power source 63 in order that the current values of all of the primary transfer rollers 5Y, 5M, 5C and 5K is 25 μA. On the other hand, when the monochrome mode is selected, the CPU 61 controls the transfer power source 63 in order that only the current value of the black primary transfer roller 5K may be set to be 35 μA, and that the current values of the other primary transfer rollers 5Y, 5M and 5C may be 5 μA.

Next, descriptions will be given to the case where each of the primary transfer rollers 5Y, 5M, 5C and 5K is pressed to each of the photosensitive bodies 1Y, 1M, 1C and 1K, respectively, through the endless belt-like intermediate transfer body 70 as shown in FIGS. 1 and 2, in both of the cases of the full color mode and the subtractive color mode including the monochrome mode.

The process speed of the image forming apparatus is 220 mm/s in the case of using a paper of the A-4 size, and each of the primary transfer rollers 5Y, 5M, 5C and 5K is a sponge roller having a resistance value of $1\times10^7$ Ω and a diameter of 20 mm. In addition, their transfer control is constant voltage control.

The details of the full color mode have been described above. Table 1 was obtained by changing the transfer current of each of the primary transfer rollers 5Y, 5M, 5C and 5K for forming a red toner image, which color is a synthesized monochrome color of yellow Y and magenta M, as the monochrome (single color) mode of the subtractive color mode, and by checking the states of peeling discharges, and transfer rate values.

TABLE 1

| TEST No. | PRIMARY TRANSFER CURRENT VALUE (μA) Y | M | C | K | STATE OF PEELING DISCHARGE | TRANSFER RATE % |
|---|---|---|---|---|---|---|
| 1 | 25 | 25 | 25 | 25 | C | 95 |
| 2 | 35 | 35 | 35 | 35 | A | 80 |
| 3 | 15 | 15 | 15 | 15 | C | 80 |
| 4 | 35 | 35 | 25 | 25 | AB | 75 |
| 5 | 25 | 25 | 35 | 35 | C | 70 |
| 6 | 25 | 25 | 15 | 15 | B | 90 |
| 7 | 25 | 25 | 10 | 10 | A | 95 |
| 8 | 25 | 25 | 5 | 5 | A | 96 |
| 9 | 25 | 25 | 0 | 0 | A | 90 |

In Table 1, "A" designates the state in which no peeling discharge was generated at all; "B" designates the state in which peeling discharges were generated to practically insignificant degrees; and "C" designates the state in which a transfer image was distorted not to be practically used.

From Table 1, it is known that, when both of the primary transfer currents of yellow Y and magenta M to be used for synthesizing the red color are 25 μA, and when both of the primary transfer currents of the other two colors (cyan and black) are any one of 5 μA, 10 μA or 0, the avoidance of the peeling discharges is in very good state and the transfer rates are very high.

It can be also known that the following cases are very good for suppressing the peeling discharges and for improving the transfer rates: the case where the output values of the transfer sections for transferring toner images from the photosensitive bodies corresponding to the color toners not to be used are set to be a half or less including zero, especially the cases of 10 μA, 5 μA and 0 μA, to the output value of 25 μA of the transfer sections for transferring toner images from the photosensitive bodies corresponding to the color toners to be used. In particular, the case where the transfer current is 5 μA is the optimum from the point of view of the transfer rates.

Moreover, the output values of the transfer sections for transferring images from the photosensitive bodies corresponding to the color toners not to be used are preferably more than zero. Such settings make it possible to prevent the distortion of the transferred toner images on the endless belt-like intermediate transfer body 70 when the toner images pass the transfer sections corresponding to the color toners not to be used.

Table 2 can be obtained by referring to the above-mentioned results and by tabularizing the combinations of the photosensitive bodies to be used for producing the color image of each of the monochromes of yellow (Y), magenta (M), cyan (C), black (K), red (R), blue (B) and green (G), and an optimum value of transfer current to be supplied to each of the primary transfer rollers 5Y, 5M, 5C and 5K of all of the photosensitive bodies 1Y, 1M, 1C and 1K including the ones other than the photosensitive bodies to be used. Hereupon, NECESSARY COLORS in Table 2 indicate each mode.

TABLE 2

| NECESSARY COLOR | USING TONER (COMBINATION OR SINGLE) | PRIMARY TRANSFER CURRENT VALUE (μA) Y | M | C | K |
|---|---|---|---|---|---|
| Y | Y | 25 | 5 | 5 | 5 |
| M | M | 5 | 25 | 5 | 5 |
| C | C | 5 | 5 | 25 | 5 |
| RED | Y, M | 25 | 25 | 5 | 5 |
| BLUE | M, C | 5 | 25 | 25 | 5 |
| GREEN | C, Y | 25 | 5 | 25 | 5 |

For forming the color image of each monochrome, a transfer table such as Table 2 is previously stored in the transfer table storage unit 67. Then, when a monochrome mode is selected through the operation unit 68, the CPU 61 converts an image data on the basis of the print rate data table stored in the print rate data table storage unit 66 to accord with the selected mode. Then, the CPU 61 reads the current value or the voltage value of each of the primary transfer rollers 5Y, 5M, 5C and 5K from the transfer table of Table 2 stored in the transfer table storage unit 67 according to the selected mode to be the transfer rates corresponding to the selected mode. For example, in the mode in which the necessary color is yellow Y, only the current value of the yellow Y primary transfer roller 5Y is set to be 25 μA, and the current values of the other primary transfer rollers 5M, 5C and 5K are set to be 5 μA. Moreover, in the mode in which the necessary color is magenta M, only the current value of the magenta M primary transfer roller 5M is set to be 25 μA, and the current values of the other primary transfer rollers 5Y, 5C and 5K are set to be 5 μA. Furthermore, in the mode in which the necessary color is cyan C, only the current value of the cyan C primary transfer roller 5C is set to be 25 μA, and the current values of the other primary transfer rollers 5Y, 5M and 5K are set to be 5 μA. Furthermore, in the mode in which the necessary color is red, only the current values of the yellow Y primary transfer roller 5Y and the magenta M primary transfer roller 5M are set to be 25 μA, and the current values of the other primary transfer rollers 5C and 5K are set to be 5 μA. Furthermore, in the mode in which the necessary color is blue, only the current values of the magenta M primary transfer roller 5M and the cyan C primary transfer roller 5C are set to be 25 μA, and the current values of the other primary transfer rollers 5Y and 5K are set to be 5 μA. Moreover, in the mode in which the necessary color is green, only the current values of the yellow Y primary transfer roller 5Y and the cyan C primary transfer roller 5C are set to be 25 μA, and the current values of the other primary transfer rollers 5M and 5K are set to be 5 μA.

As described above, the present embodiment makes it possible to stably form a full color image with the aid of a plurality of color toners and a monochrome image using subtractive color toners. Moreover, it becomes possible not to produce a defect of an image generated by an image forming apparatus in which the full color mode and the subtractive color mode can be switched. In particular, each function of prevention of lowering of transfer rates, prevention of re-transferring of toners to the image bearing bodies on the downstream side, and prevention of the peeling discharges in transfer regions between the endless belt-like intermediate transfer body and the image bearing bodies can be stably and surely achieved.

In the present embodiment, the first mode is made to be the full color mode for forming an image using a plurality of colors, and the second mode is made to be the monochrome mode for forming an image using colors less than those of the first mode. However, the differences between the first mode and the second mode are not limited to that.

For example, the first mode may be made to be a mode for forming an image using a plurality of colors including a first color, and the second mode may be made to be a mode for forming an image using a less colors including the first color than those of the first mode. In such a case, it is preferable that the transfer rate of the first color toner image in the second mode is larger than the transfer rate of the first color toner image in the first mode. To put it more concretely, when a description is given to an exemplification of the mode in which the necessary color is yellow Y and the mode in which the necessary color is red, because yellow Y is used in both of the modes, the yellow Y is the first color just in these two modes. Moreover, according to the total number of the colors to be used, the mode in which the necessary color is red is the first mode, and the mode in which the necessary color is yellow Y is the second mode. That is, in the case where the transfer rate of yellow Y in the mode in which the necessary color is yellow y is set to be larger than the transfer rate of yellow y in the mode in which the necessary color is red, it becomes possible to form an image having a good image quality more stably.

Moreover, the first mode may be set to be a mode for forming an image using a first number of colors, and the second mode may be set to be a mode for forming an image using a smaller number of colors than the first number. In such a case, it is preferable to set transfer rates of the toner images in the second mode larger than transfer rates of the toner images in the first mode with regard to at least one color to be used in the second mode. When the mode in which the necessary color is cyan C and the mode in which the necessary color is red are concretely exemplified to be described, the mode in which the necessary color is red is the first mode and the mode in which the necessary color is cyan C is the second mode according to the total number of the colors to be used. That is, when the transfer rate of cyan C in the mode in which the necessary color is cyan C is set to be larger than the transfer rates of yellow Y and magenta M in the mode in which the necessary color is red, it is possible to form an image having a good image quality more stably.

What is claimed is:

1. An image forming apparatus comprising:

a transfer section which transfers a toner image onto an intermediate transfer body or a transfer material to form an image on the intermediate transfer body or the transfer material;

a selection section for selecting one mode among a plurality of modes including a first mode for forming the image by using a plurality of colors including a first color and a second mode for forming the image by using less number of colors including the first color than that of the colors in the first mode; and a control section for controlling a current value or a voltage value of the transfer section to control a transfer rate of each of the toner images, wherein the control section controls the transfer section in order that a transfer rate of a toner image of the first color in the second mode is larger than that of a toner image of the first color in the first mode when toner images are transferred onto the intermediate transfer body or the transfer material by the transfer section.

2. The image forming apparatus of claim 1, wherein, the image is formed by using only one color in the second mode.

3. The image forming apparatus of claim 1, further comprising a plurality of image bearing bodies, on which the toner images having different colors from one another are formed, wherein an image bearing body on which a toner image is not formed among the plurality of image bearing bodies is separated from the intermediate transfer body in the second mode.

4. The image forming apparatus of claim 1, wherein the image forming apparatus comprises the intermediate transfer body having an endless belt-like shape.

5. The image forming apparatus of claim 1, further comprising a carry section for carrying the transfer material, which has an endless belt-like shape.

6. The image forming apparatus of claim 1, wherein the first mode is a full color mode using the toner images formed on all of the plurality of image bearing bodies, and the second mode is a monochrome mode using a toner image formed on one of the image bearing bodies among the plurality of image bearing bodies.

7. The image forming apparatus of claim 1, wherein the control section controls a transfer rate of each of the toner images turn into the same transfer rate in the first mode.

8. The image forming apparatus of claim 1, further comprising a plurality of transfer sections severally provided corresponding to each of the plurality of image bearing bodies, wherein the control section controls a current value or a voltage value of each of the plurality of transfer sections turn into the same current value or the same voltage value in the first mode.

9. An image forming apparatus comprising:

a transfer section which transfers a toner image onto an intermediate transfer body or a transfer material to form an image on the intermediate transfer body or the transfer material;

a selection section for selecting one mode among a plurality of modes including a first mode for forming the image by using a first number of colors and a second mode for forming the image by using a number of colors which is smaller than the first number of colors; and a control section for controlling a current value or a voltage value of the transfer section to control a transfer rate of each of the toner images, wherein the control section controls the transfer section in order that a transfer rate of a toner image in the second mode is larger than that of a toner image in the first mode with regard to at least one color used in the second mode when toner images are transferred onto the intermediate transfer body or the transfer material by the transfer section.

10. The image forming apparatus of claim 9, wherein, the image is formed by using only one color in the second mode.

11. The image forming apparatus of claim 9, further comprising a plurality of image bearing bodies, on which the toner images having different colors from one another are formed, wherein an image bearing body on which a toner image is not formed among the plurality of image bearing bodies is separated from the intermediate transfer body in the second mode.

12. The image forming apparatus of claim 9, wherein the image forming apparatus comprises the intermediate transfer body having an endless belt-like shape.

13. The image forming apparatus of claim 9, further comprising a carry section for carrying the transfer material, which has an endless belt-like shape.

14. The image forming apparatus of claim 9, wherein the first mode is a full color mode using the toner images formed on all of the plurality of image bearing bodies, and the second mode is a monochrome mode using a toner image formed on one of the image bearing bodies among the plurality of image bearing bodies.

15. The image forming apparatus of claim 9, wherein the control section controls a transfer rate of each of the toner images turn into the same transfer rate in the first mode.

16. The image forming apparatus of claim 9, further comprising a plurality of transfer sections severally provided corresponding to each of the plurality of image bearing bodies, wherein the control section controls a current value or a voltage value of each of the plurality of transfer sections turn into the same current value or the same voltage value in the first mode.

17. An image forming apparatus comprising:

a transfer section which transfers a toner image onto an intermediate transfer body or a transfer material to form an image on the intermediate transfer body or the transfer material;

a selection section for selecting one mode among a plurality of modes including a first mode for forming the image by using a plurality of colors and a second mode for forming the image by using less number of colors than that of the colors in the first mode; and a control section for controlling a current value or a voltage value of the transfer section to control a transfer rate of each of the toner images, wherein the control section controls the transfer section in order that a transfer rate of a toner image in the second mode is larger than that of a toner image in the first mode when toner images are transferred onto the intermediate transfer body or the transfer material by the transfer section.

18. The image forming apparatus of claim 17, wherein, the image is formed by using only one color in the second mode.

19. The image forming apparatus of claim 17, further comprising a plurality of image bearing bodies, on which the toner images having different colors from one another are formed, wherein an image bearing body on which a toner image is not formed among the plurality of image bearing bodies is separated from the intermediate transfer body in the second mode.

20. The image forming apparatus of claim 17, wherein the image forming apparatus comprises the intermediate transfer body having an endless belt-like shape.

21. The image forming apparatus of claim 17, further comprising a carry section for carrying the transfer material, which has an endless belt-like shape.

22. The image forming apparatus of claim 17, wherein the first mode is a full color mode using the toner images formed on all of the plurality of image bearing bodies, and the second mode is a monochrome mode using a toner image formed on one of the image bearing bodies among the plurality of image bearing bodies.

23. The image forming apparatus of claim 17, wherein the control section controls a transfer rate of each of the toner images turn into the same transfer rate in the first mode.

24. The image forming apparatus of claim 17, further comprising a plurality of transfer sections severally provided corresponding to each of the plurality of image bearing bodies, wherein the control section controls a current value or a voltage value of each of the plurality of transfer sections turn into the same current value or the same voltage value in the first mode.

* * * * *